US006585537B1

(12) United States Patent
Lee

(10) Patent No.: US 6,585,537 B1
(45) Date of Patent: Jul. 1, 2003

(54) CABLE END CONNECTOR WITH LOCKING MEMBER

(75) Inventor: George Lee, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/280,515

(22) Filed: Oct. 24, 2002

(51) Int. Cl.[7] ..... H01R 13/627
(52) U.S. Cl. ..... 439/358; 439/606; 439/352
(58) Field of Search ..... 439/357, 358, 439/352, 353, 362, 368, 606

(56) References Cited

U.S. PATENT DOCUMENTS

| | | | | | |
|---|---|---|---|---|---|
| 5,445,534 | A | | 8/1995 | Ishizuka et al. | 439/352 |
| 5,672,071 | A | | 9/1997 | Ceru | 439/353 |
| 5,716,228 | A | * | 2/1998 | Chen | 439/358 |
| 5,727,963 | A | * | 3/1998 | LeMaster | 439/358 |
| 5,749,746 | A | * | 5/1998 | Tan et al. | 439/357 |
| 5,775,931 | A | | 7/1998 | Jones | 439/358 |
| 5,876,232 | A | * | 3/1999 | Matsushita et al. | 439/357 |
| 5,924,886 | A | | 7/1999 | Achammer et al. | 439/372 |
| 5,938,470 | A | * | 8/1999 | Kashiyama | 439/489 |
| 5,941,726 | A | * | 8/1999 | Koegel et al. | 439/358 |
| 5,971,790 | A | * | 10/1999 | Rohde | 439/357 |
| 6,099,339 | A | * | 8/2000 | Yanagida et al. | 439/358 |
| 6,132,234 | A | * | 10/2000 | Waidner et al. | 439/358 |
| 6,203,353 | B1 | * | 3/2001 | Huang et al. | 439/352 |
| 6,431,887 | B1 | | 8/2002 | Yeomans et al. | 439/108 |

* cited by examiner

*Primary Examiner*—Tulsidas C Patel
(74) *Attorney, Agent, or Firm*—Wei Te Chung

(57) ABSTRACT

A cable end connector (1) for mating with a complementary connector (7) comprises a housing (2) defining a receiving space (21) therein, a plurality of contacts (31) mounted in the housing, a cable (5) having a plurality of conductors (50) electrically connecting the contacts, a cover (4) over-molded with and enclosing a rear end (27) of the housing, and a locking member (6). The locking member has a pushing portion (61) abutting against a fulcrum portion (45) of the cover, a pair of securing portions (63) extending sidewardly from the pushing portion and securing to a pair of sides of the housing, and a latching portion (62) extending forwardly from the pushing portion adapted for locking with the complementary connector and providing a mechanical connection therebetween.

18 Claims, 11 Drawing Sheets

CABLE END CONNECTOR WITH LOCKING MEMBER

CROSS-REFERENCE TO RELATED APPLICATION

This patent application is related to a co-pending application Ser. No. 10/241,551, filed on Sep. 11, 2002, invented by Jerry Wu, and entitled "CABLE END CONNECTOR WITH LOCKING MEMBER" and assigned to the same assignee as this patent application. This patent application is related to a co-pending application Ser. No. 10/242,099, filed on Sep. 11, 2002, invented by Jerry Wu, and entitled "ELECTRICAL CONNECTOR WITH LOCKING MEMBER" and an application is also related to Ser. No. 10/271,064 filed on Oct. 15, 2002, invented by George Lee, entitled "CABLE END CONNECTOR WITH LOCKING MEMBER" and all assigned to the same assignee as this patent application.

BACKGROUND OF THE INVENTION

1. Field of the Invention

The present invention relates to a cable end connector with a locking member for locking with a complementary connector.

2. Description of Related Art

Complementary electrical connectors typically include dielectric housings respectively receiving a plurality of terminals or contacts which, when the connectors are mated, establish an electrical interconnection therebetween. The complementary connectors may be male and female connectors or plug and socket connectors for electrically connecting the terminals or contacts received therein. In some instances, the connectors have complementary latches for locking the connectors together when mated. U.S. Pat. Nos. 5,445,534, 5,775,931, 5,924,886 and 6,431,887 disclose different forms of latch structures to provide reliable mechanical connection therebetween.

There exists in the art an electrical connector known as a Serial Advanced Technology Attachment (Serial ATA) connector which is generally used for disk drives and storage peripherals. Especially, the Serial ATA connectors according the Serial ATA standard are featured in fewer electrical contacts than other conventional electrical connectors and are relatively tiny in configurations, and it is more desirable for the Serial ATA connector to have a locking member for providing a reliable mechanical and electrical connection with a complementary connector.

Hence, an electrical connector with a locking member for locking the electrical connector with a complementary connector is required to overcome the disadvantages of the related art.

SUMMARY OF THE INVENTION

An object, therefore, of the present invention is to provide a cable end connector with a locking member for locking the connector with a complementary connector.

Another object of the present invention is to provide a cable end connector with a locking member adapted to easily lock/release with/from a complementary connector.

In order to achieve the objects set forth, a cable end connector for mating with a complementary connector comprises a housing defining a receiving space therein adapted for receiving a mating portion of the complementary connector, a plurality of contacts mounted in the housing, a cable having a plurality of conductors electrically connecting the contacts, a cover over-molded with and enclosing a rear end of the housing, and a locking member. The locking member has a pushing portion abutting against a fulcrum portion of the cover, a pair of securing portions extending sidewardly from the pushing portion and securing to a pair of sides of the housing, and a latching portion extending forwardly from the pushing portion adapted for locking with the complementary connector and providing a mechanical and electrical connection therebetween.

Other objects, advantages and novel features of the invention will become more apparent from the following detailed description when taken in conjunction with the accompanying drawings.

DETAILED DESCRIPTION OF THE INVENTION

Figure 9:
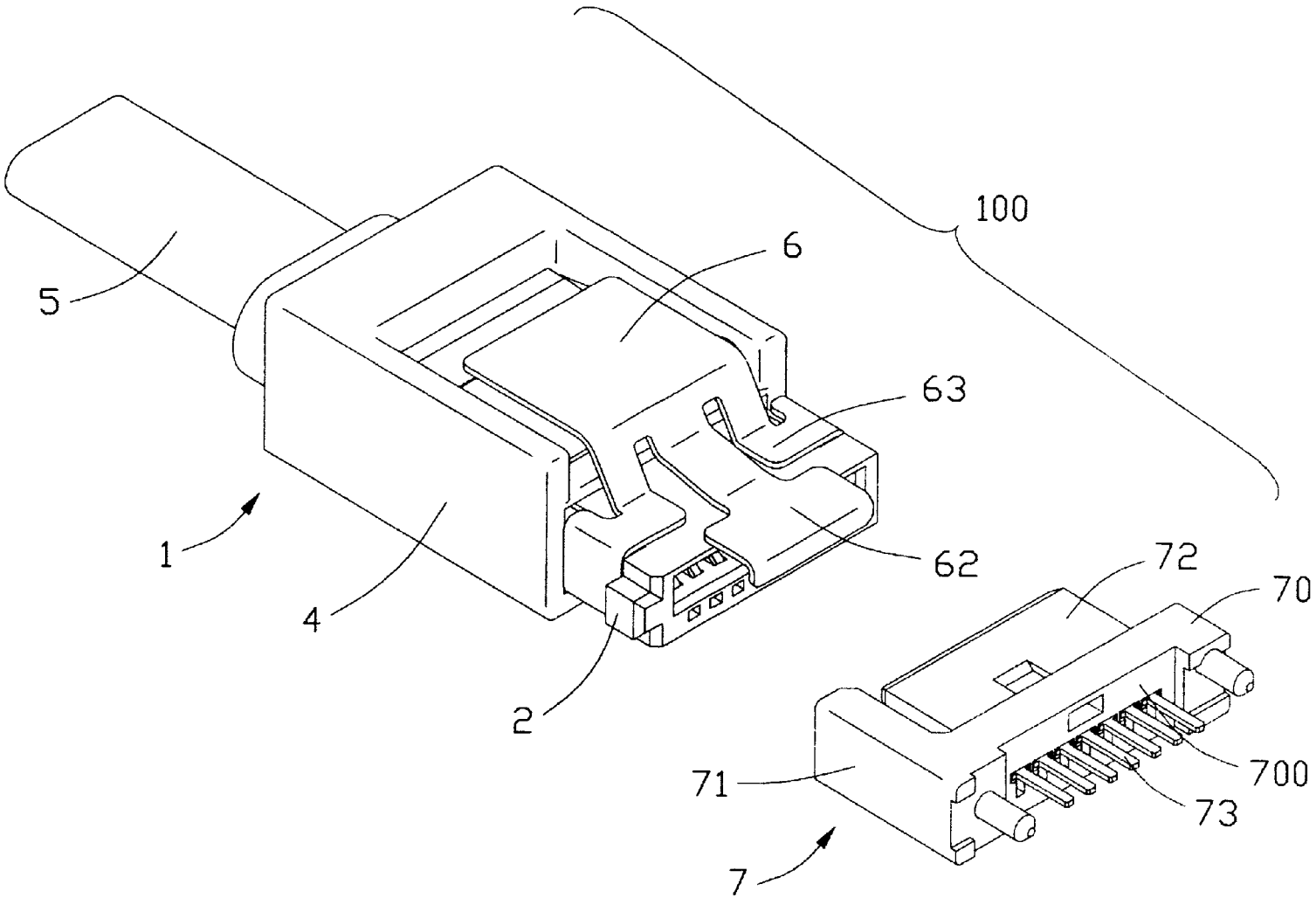
FIG. 9 is a perspective view of an electrical connector assembly to show the cable end connector and a complementary connector in accordance with the present invention.

Referring to FIG. 9, an electrical connector assembly 100 in accordance with the present invention comprises a cable end connector 1 and a complementary connector 7. In the embodiment shown, the cable end connector 1 and the complementary connector 7 are typical standard Serial ATA connectors. However, in alternative embodiments, the electrical connectors could be provided as other than Serial ATA electrical connectors.

Figure 1:
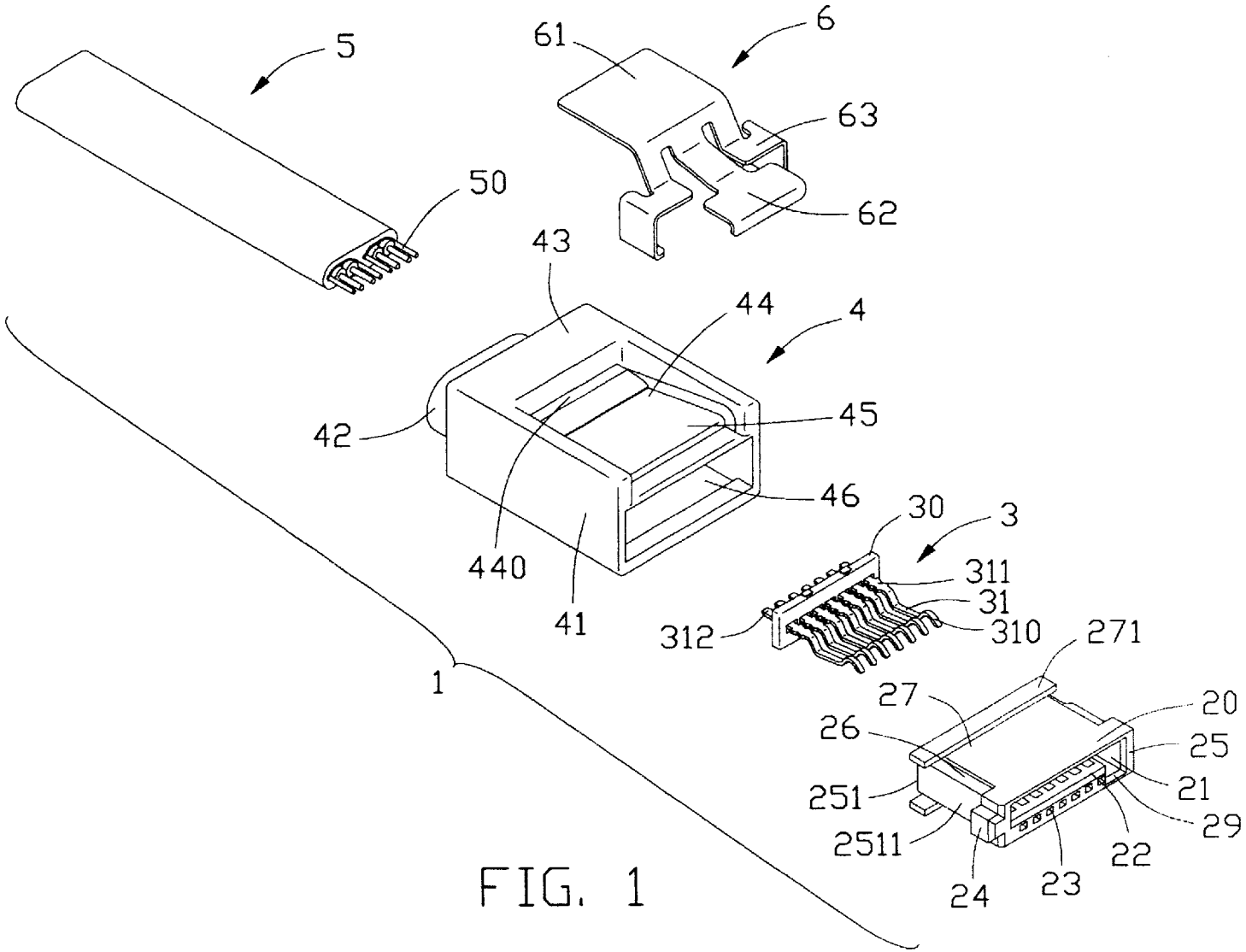
FIG. 1 is an exploded, perspective view of a cable end connector in accordance with the present invention.
Figure 2:
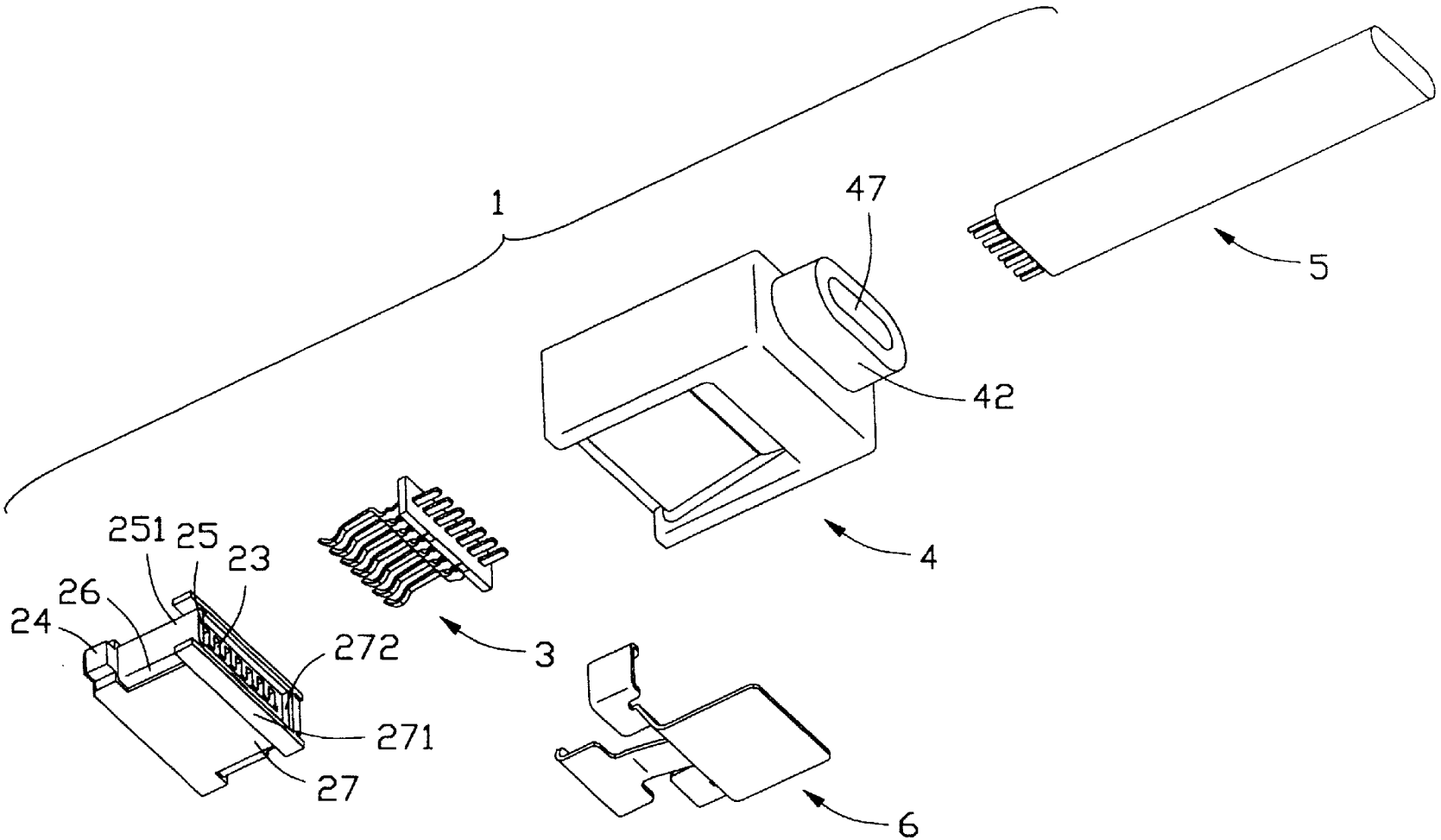
FIG. 2 is a view similar to FIG. 1, but taken from rear and bottom aspects.
Figure 3:
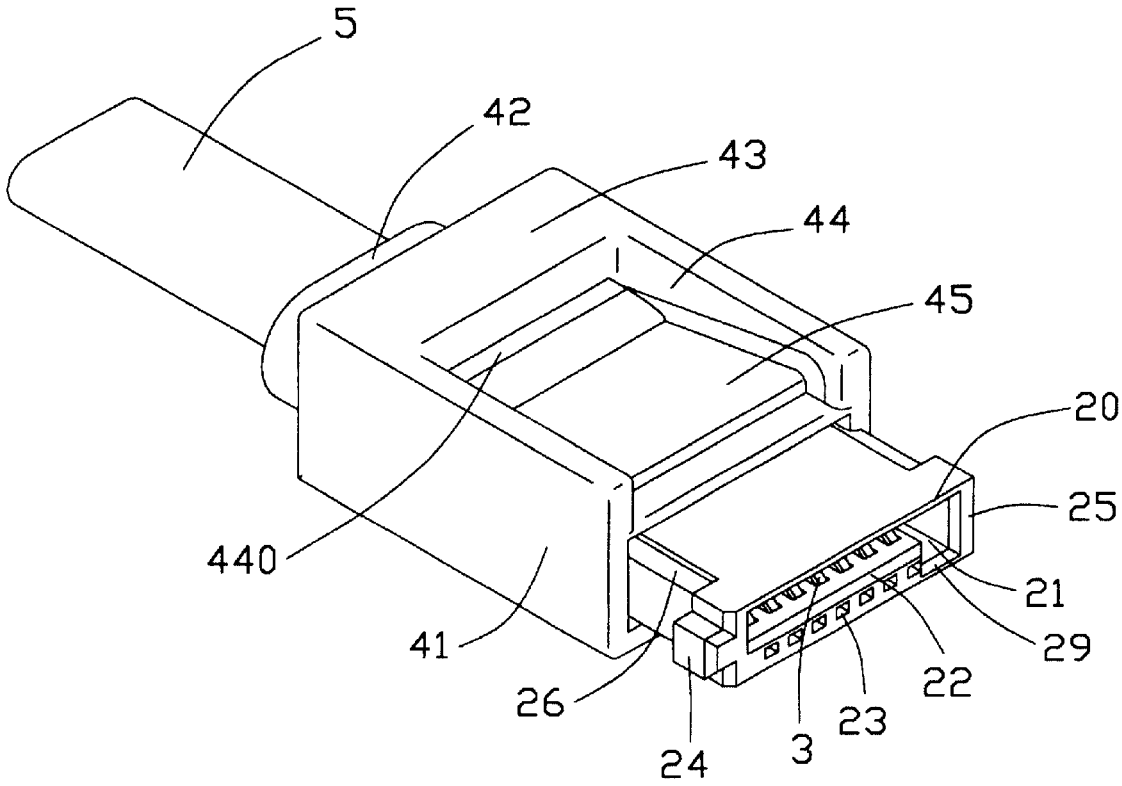
FIG. 3 is an assembled, perspective view of the cable end connector of FIG. 1, except for a locking member.
Figure 4:
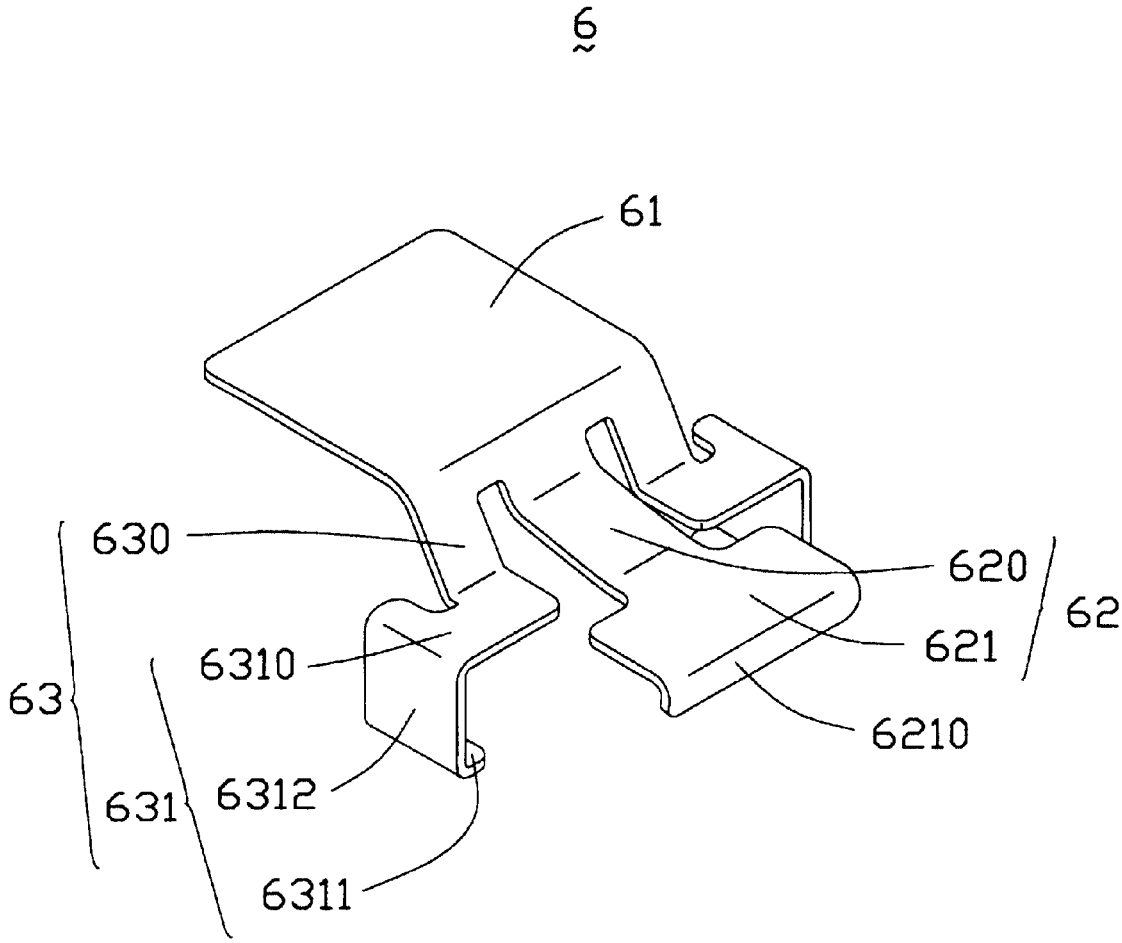
FIG. 4 is a perspective view of the locking member of the cable end connector.
Figure 5:
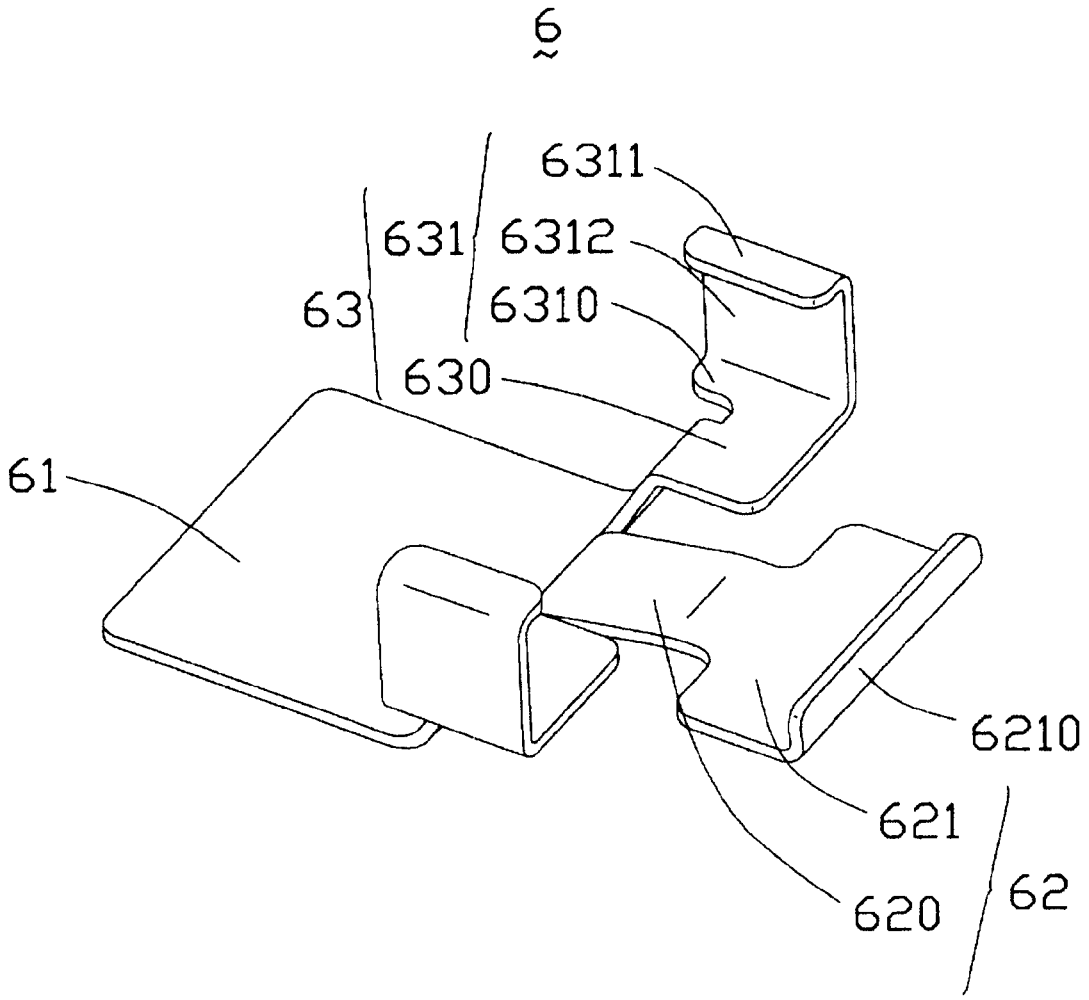
FIG. 5 is a view similar to FIG. 4, but taken from rear and bottom aspects.
Figure 6:
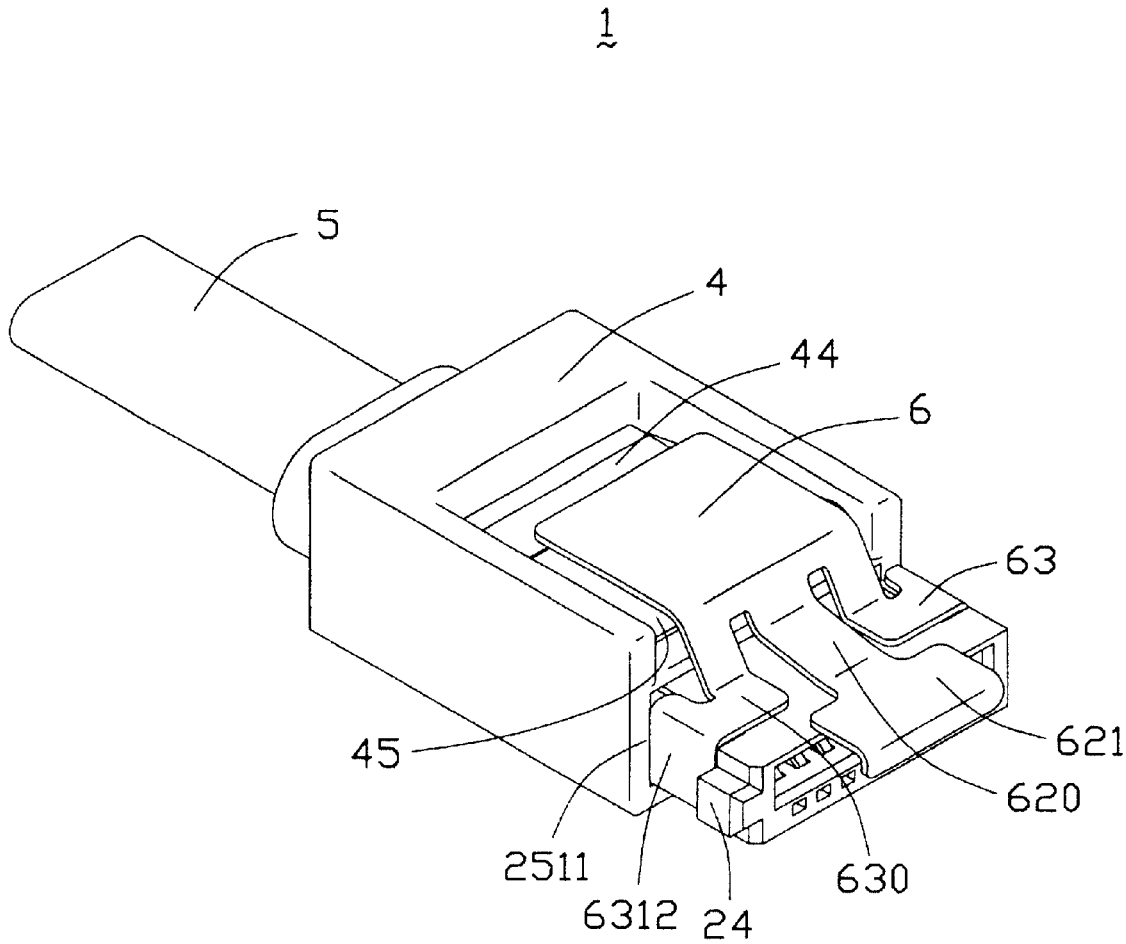
FIG. 6 is an assembled view of the cable end connector of FIG. 1.
Figure 7:
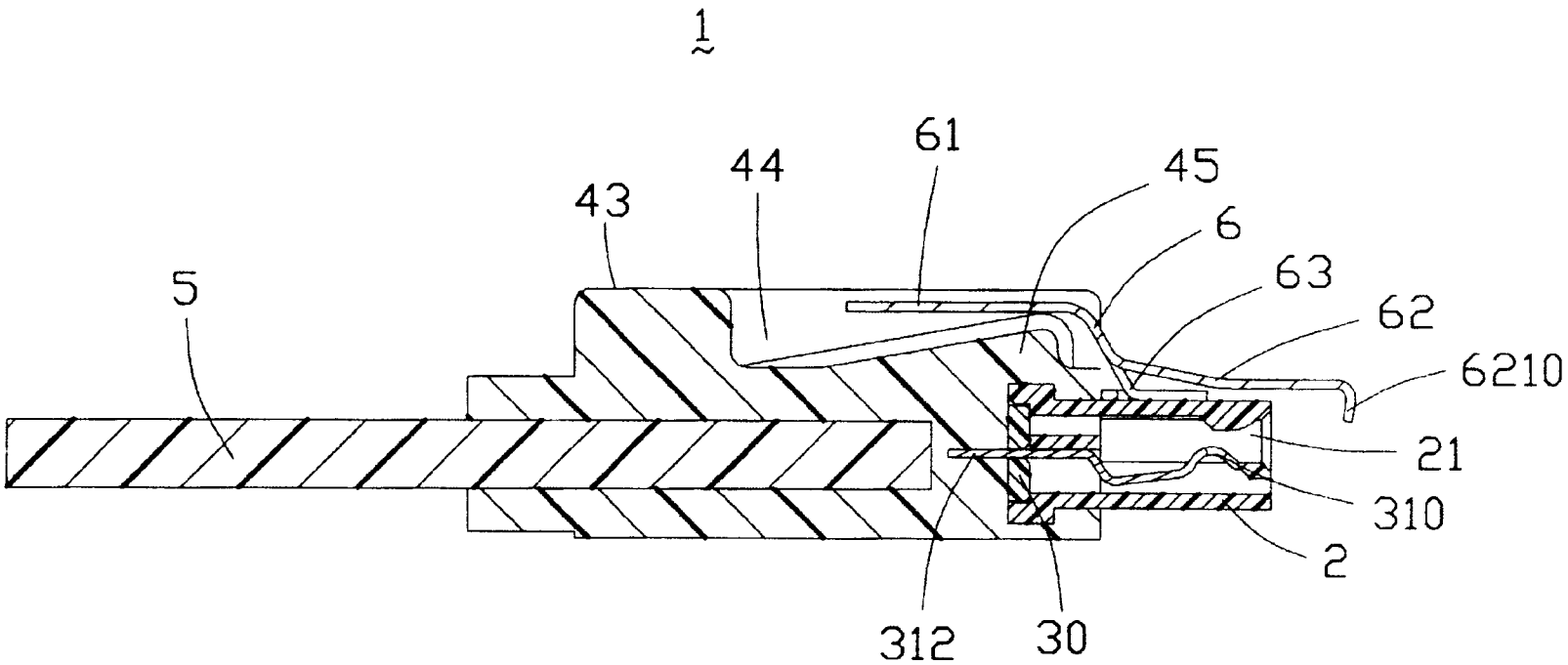
FIG. 7 is a cross-sectional view taken along line 7—7 of FIG. 6.
Figure 8:
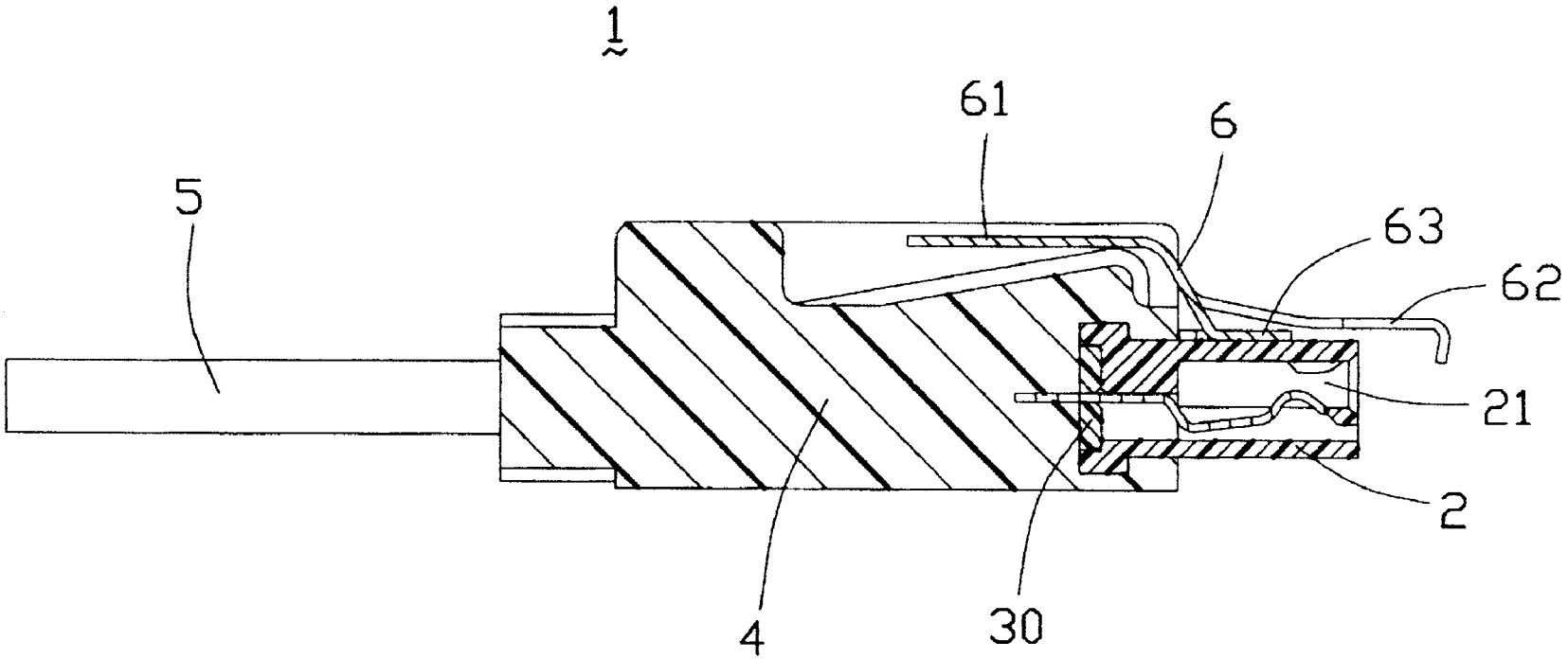
FIG. 8 is a cross-sectional view taken along line 8—8 of FIG. 6.

Referring to FIGS. 1 and 2, the cable end connector 1 comprises an insulative housing 2, a contact insert 3, a cover 4, a cable 5, and a locking member 6. Referring to FIGS. 1–3 and in conjunction with FIGS. 7 and 8, the insulative housing 2 is a rectangular body and comprises an upper wall 20, a lower wall 29 opposite to the upper wall 20, and a pair of side walls 25 jointing the upper and lower walls 20, 29. An L-shaped receiving space 21 is defined between the upper and lower walls 20, 29 for receiving the complementary connector 7. A block 22 is formed on the lower wall 29 and protrudes into the receiving space 21. A plurality of passageways 23 is defined through the block 22. A rear portion of each side wall 25 is partly cut off to define a channel 251. The upper and lower walls 20, 29 each defines a pair of recesses 26 communicating with corresponding channel 251 on a pair of sides thereof. A guiding projection 24 protrudes sidewardly from a side surface of the side wall 25. A pair of ribs 271 is formed on an upper surface and a lower surface of the housing 2 and adjacent to a rear end 27 thereof for engaging with the cover 4, and a receiving slot 272 is defined in the rear end 27 of the housing 2 for receiving the contact insert 3.

The contact insert 3 comprises a plurality of contacts 31 and a retainer 30 defining a plurality of slots therein. Each contact 31 comprises a retention portion 311 for engaging with corresponding passageway 23 defined in the block 22, a mating portion 310 extending forwardly from the retention portion 311 for being received in corresponding passageway 23 and partly exposed into the receiving space 21, and a tail portion 312 extending rearwardly from the retention portion 311 for electrically connecting the cable 5.

The cable 5 comprises a plurality of conductors 50 extending beyond a front end thereof.

The cover 4 is over-molded with the housing 2 and the cable 5. The cover 4 comprises a rectangular body 41 and a rear portion 42 extending rearwardly from the body 41. A channel 44 is defined in a front portion of the cover 4 and a holder portion 43 is formed in a rear portion of the cover 4. An inclined fulcrum portion 45 extends upwardly and forwardly from a bottom surface 440 of the channel 44 and into the channel 44. A receiving cavity 46 is defined in the front portion of the cover 4 and is below the channel 44 for receiving the rear end 27 of the housing 2. The rear portion 42 of the cover 4 defines an opening 47 therethrough for receiving the front end of the cable 5.

Referring to FIGS. 1, 2, 4 and 5, the locking member 6 comprises a flat pushing portion 61, a pair of securing portions 63 extending forwardly then sidewardly from a front end of the pushing portion 61, and a latching portion 62 extending downwardly then forwardly from the pushing portion 61 and locating between the pair of the securing portions 63.

The latching portion 62 comprises a stretching portion 620 and an enlarged portion 621 extending forwardly from a free end of the stretching portion 620. A hook portion 6210 is bent downwardly from a free end of the enlarged portion 621 for locking with the complementary connector 7. Each securing portion 63 comprises a stretching portion 630 extending downwardly and forwardly then flatly from the front end of the pushing portion 61 for abutting against the upper surface of the housing 2, and a retaining portion 631 extending sidewardly from the stretching portion 630. The retaining portion 631 comprises first and second portions 6310, 6311, and a connection portion 6312 connecting the first and second portions 6310, 6311. The first portion 6310 extends sidewardly from an outer edge of the stretching portion 630 for being engaged with the recess 26 defined in the upper surface of the housing 2. The second portion 6311 is opposite to the first portion 6310 for being engaged with the recess 26 defined in the lower surface of the housing 2.

Figure 11:
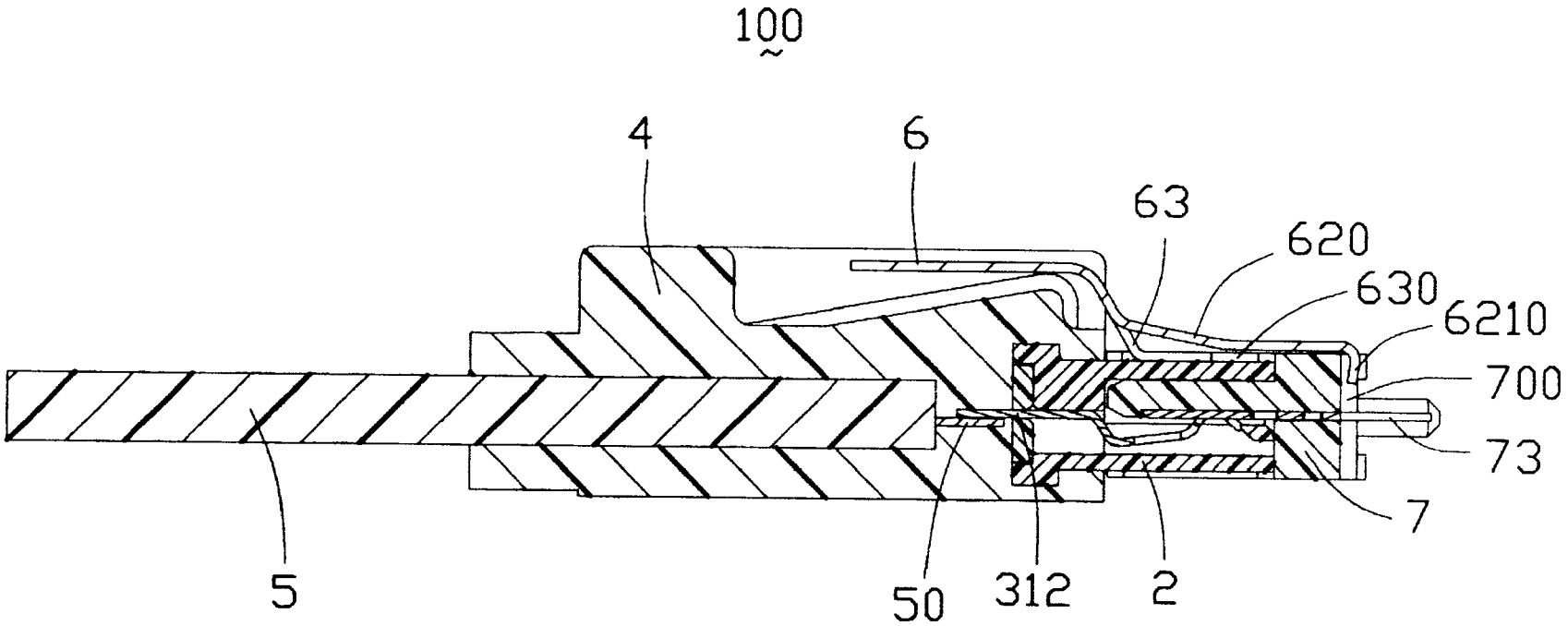
FIG. 11 is a cross-sectional view taken along line 11—11 of FIG. 10.

Referring to FIGS. 3, 6, 7 and 8 and in conjunction with FIG. 11, in assembly, the contacts 31 are first assembled into the housing 2 in a rear-to-front direction. The mating portions 310 and the retention portions 311 of the contacts 31 are received into the passageways 23 and the tail portions 312 exposed outside the housing 2. The retainer 30 is then pushed and received into the receiving slot 272 defined in the rear end 27 of the housing 2, and the tail portions 312 of the contacts 31 protrude through the slots defined in the retainer 30. The conductors 50 of the cable 5 are soldered to the tail portions 312 of the contacts 31. The cover 4 is then over-molded with the rear end 27 of the housing 2 with the conductors 50 received into the opening 47. The pair of ribs 271 is received in the receiving cavity 43 and engaging with inner surfaces of the receiving cavity 43. The locking member 6 is then assembled to the housing 2 and the cover 4. The pushing portion 61 is received in the channel 44 and the front end thereof abuts against the fulcrum portion 45 which can prevent the locking member 6 from being pushed too much and destroyed. The enlarged portion 621 of the latching portion 62 extends beyond a front surface of the housing 2 for locking with the complementary connector 7. The stretching portion 630 of each securing portion 63 abuts against the upper surface of the housing 2, the connection portion 6312 surrounds a side surface 2511 of the channel 251, and the first and second portions 6310, 6311 engage with the recesses 26 defined in upper and lower surfaces of the housing 2 respectively.

Figure 10:
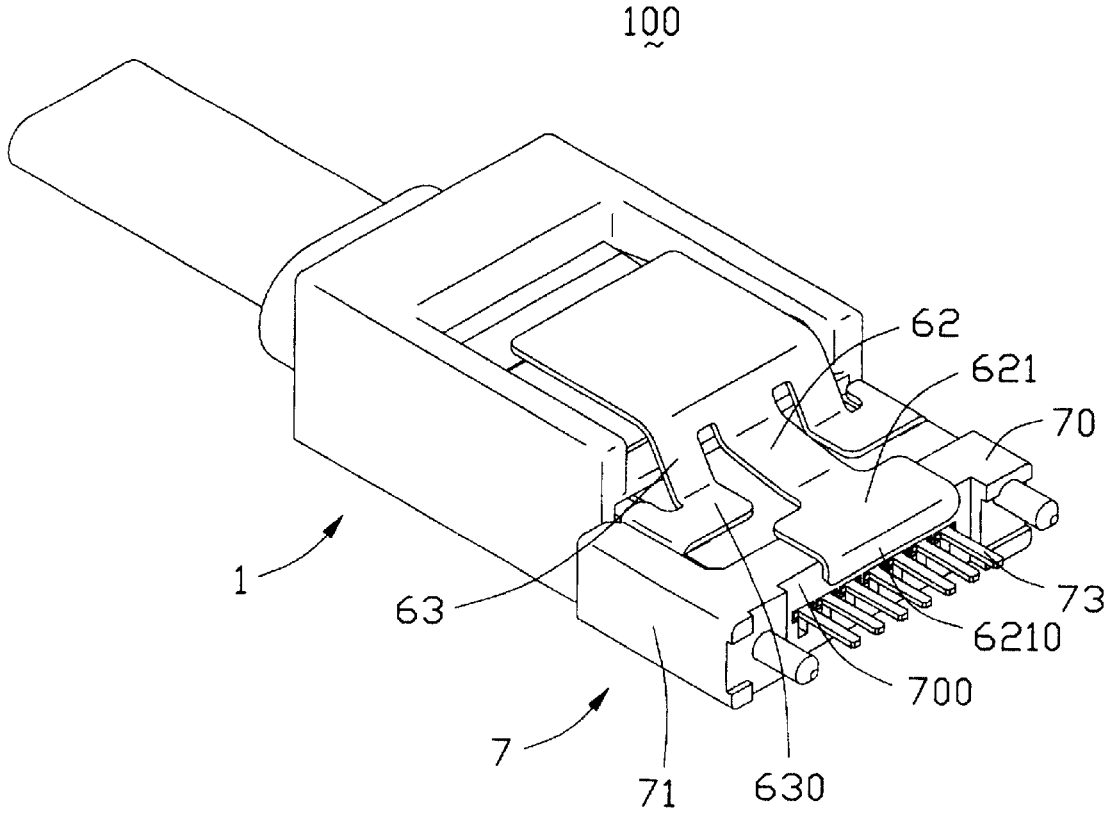
FIG. 10 is an assembled view of the cable end connector and the complementary connector of FIG. 9.

Referring to FIGS. 9, 10 and 11, the complementary connector 7 comprises a base portion 70, a guiding post 71 extending forwardly from one end of the base portion 70, a tongue portion 72 extending forwardly from a middle of the base portion 70. A plurality of terminals 73 is assembled to the tongue portion 72 and each terminal 73 has a tail portion extending beyond a rear surface 700 of the base portion 70 for extending through and soldered with a through hole of a printed circuit board (not shown).

When the cable end connector 1 is mated with the complementary connector 7, the guiding projection 24 of the cable end connector 1 is received into the guiding post 71 of the base portion 70 of the complementary connector 7, the tongue portion 72 is received into the receiving space 21 with the terminals 73 electrically contacting the contacts 31 exposed into the receiving space 21, the hook portion 6210 of the latching portion 62 of the locking member 6 locking and abutting against the rear surface 700 of the base portion 70, and the enlarged hook portion 6210 can lock the complementary connector 7 with the cable end connector 1 more reliably. When the cable end connector 1 is separated from the complementary connector 7, push a rear end of the pushing portion 61 downwardly toward the channel 44, at the same time, push the holder portion 43 rearwardly. The fulcrum portion 45 supports the pushing portion 61 and functions as a fulcrum, at the same time, the hook portion 6210 of the latching portion 62 moves upwardly and is separated from the rear surface 700 of the base portion 70. Thus, the cable end connector 1 is separated from the complementary connector 7.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector for mating with a complementary connector, comprising:

an insulative housing defining a receiving space therein adapted for receiving a mating portion of the complementary connector;

a plurality of contacts mounted in the housing;

a cable having a plurality of conductors electrically connecting the contacts;

a cover over-molded with and enclosing a rear end of the housing; and a locking member having a pushing portion abutting against a fulcrum portion of the cover, a pair of securing portions extending sidewardly from the pushing portion and securing to a pair of sides of the housing, and a latching portion extending forwardly from the pushing portion adapted for locking with the complementary connector and providing a mechanical and electrical connection between the cable end connector and the complimentary connector.

2. The cable end connector as claimed in claim 1, wherein each securing portion comprises a stretching portion extending downwardly and forwardly from a front end of the pushing portion and securing to an upper surface of the housing, and a retaining portion extending sidewardly from the stretching portion.

3. The cable end connector as claimed in claim 2, wherein each retaining portion of the securing portion comprises first and second portions, and a connection portion connecting the first and second portions.

4. The cable end connector as claimed in claim 3, wherein the housing comprises an upper wall, a lower wall opposite to the upper wall, and a pair of side walls jointing the upper and lower walls, each side wall is partly cut off to define a channel, and the connection portion of each securing portion is correspondingly received in the channel.

5. The cable end connector as claimed in claim 4, wherein the housing defines a pair of recesses on a pair of sides of the upper and lower walls respectively, and the first and second portions of the securing portions engage with the recesses of the housing.

6. The cable end connector as claimed in claim 1, wherein the latching portion locates between the pair of securing portions and extends beyond a front surface of the housing.

7. The cable end connector as claimed in claim 6, wherein the latching portion comprises a stretching portion and an enlarged portion extending forwardly from a free end of the stretching portion, and a hook portion bending downwardly from a front end of the enlarged portion adapted for locking with the complementary connector.

8. The cable end connector as claimed in claim 4, wherein the receiving space of the housing has an L-shape and is defined between the upper and lower walls.

9. The cable end connector as claimed in claim 8, wherein the housing further comprises a block on the lower wall thereof and protrudes into the receiving space, a plurality of passageways is defined therethrough for receiving the contacts therein.

10. The cable end connector as claimed in claim 1, wherein the cover defines a channel in a front portion thereof and the inclined fulcrum portion extends upwardly and forwardly from a bottom surface of the channel and into the channel, the front end of the pushing portion of the locking member abuts against the fulcrum portion.

11. The cable end connector as claimed in claim 10, wherein a holder portion is formed in a rear portion of the cover adapted for being pushed rearwardly and facilitating separating the cable end connector from the complementary connector.

12. The cable end connector as claimed in claim 9, wherein each contact comprises a retention portion engaging with corresponding passageway defined in the block of the housing, a mating portion extending forwardly from the retention portion and received in corresponding passageway adapted for mating with the complementary connector, and a tail portion extending rearwardly from the retention portion and exposed outside the housing and connecting the conductors of the cable.

13. The cable end connector as claimed in claim 1, wherein the housing comprises a guiding projection protruding sidewardly from a side surface of the side wall of the housing adapted for complementing with a corresponding guiding portion of the complementary connector.

14. The cable end connector as claimed in claim 10, wherein the cover defines a receiving cavity therein and is below the channel, the housing comprises a pair of ribs formed on the upper and lower surfaces thereof and adjacent to the rear end, the ribs is received into the receiving cavity and engage with inner surfaces of the cover.

15. An electrical connector assembly adapted for being mounted on a printed circuit board, comprising:

a cable end connector comprising a housing defining a receiving space therein, a plurality of contacts mounted in the receiving space, a cable having a plurality of conductors electrically connecting the contacts, a cover enclosing a rear end of the housing, and a locking member having a pushing portion abutting against a fulcrum portion of the cover, a pair of securing portions extending sidewardly from the pushing portion and securing to a pair of sides of the housing, and a latching portion extending forwardly from the pushing portion;

a complementary connector having a base portion and a tongue portion extending forwardly from the base portion and respectively received into the receiving space of the cable end connector, a plurality of terminals received into the tongue portion and respectively electrically contacting the contacts of the cable end connector;

wherein the latching portion of the locking member locks with the base portion of the complementary connector for providing a mechanical and electrical connection between the cable end connector and the complementary connector.

16. The electrical connector assembly as claimed in claim 15, wherein the latching portion locates between the pair of securing portions and locks and abuts against a rear surface of the base portion of the complementary connector.

17. The electrical connector assembly as claimed in claim 15, wherein the cable end connector comprises a guiding projection protruding from a side surface of the housing, the base portion of the complementary connector has a guiding post locating at a side thereof, the guiding projection is respectively received into the guiding post.

18. A cable end connector comprising:

an insulative housing defining a mating port for receiving a complementary connector;

a plurality of contacts disposed in the housing;

a cable extending rearwardly away from the housing and having a plurality of conductors electrically connected to the corresponding contacts, respectively;

a cover enclosing a rear portion of the housing; and a lever type locking member secured to one of said cover and said housing, said locking member including a pushing portion around a rear end portion thereof and a latching portion around a front end portion thereof; wherein said cover includes a rearwardly downwardly inclined surface to define an oblique space above said inclined surface so as to allow the pushing portion to be moveable in said space.

* * * * *